US010066544B2

(12) United States Patent
Qian

(10) Patent No.: US 10,066,544 B2
(45) Date of Patent: Sep. 4, 2018

(54) BOX-TYPE GENERATOR DRIVEN BY ENGINE

(75) Inventor: Youheng Qian, Zhejiang (CN)

(73) Assignee: Zhejiang Everlast Power Co., Ltd. (CN)

( * ) Notice: Subject to any disclaimer, the term of this patent is extended or adjusted under 35 U.S.C. 154(b) by 1103 days.

(21) Appl. No.: 14/352,454

(22) PCT Filed: Jun. 29, 2012

(86) PCT No.: PCT/CN2012/077889

§ 371 (c)(1),
(2), (4) Date: Apr. 17, 2014

(87) PCT Pub. No.: WO2013/060161

PCT Pub. Date: May 2, 2013

(65) Prior Publication Data

US 2014/0256245 A1 Sep. 11, 2014

(30) Foreign Application Priority Data

Oct. 23, 2011 (CN) ..... 2011 1 0336907

(51) Int. Cl.

| | |
|---|---|
| ***F02B 63/04*** | (2006.01) |
| *F01P 1/02* | (2006.01) |
| *F01N 1/08* | (2006.01) |

(52) U.S. Cl.

CPC ..... *F02B 63/044* (2013.01); *F02B 63/048* (2013.01); *F01N 1/089* (2013.01); *F01N 2590/06* (2013.01); *F01P 1/02* (2013.01)

(58) Field of Classification Search

CPC combination set(s) only.
See application file for complete search history.

(56) References Cited

U.S. PATENT DOCUMENTS

| | | | | |
|---|---|---|---|---|
| 2,355,208 | A | 8/1944 | Devol et al. | |
| 5,899,174 | A | 5/1999 | Anderson et al. | |
| 7,779,793 | B2 * | 8/2010 | Ito | F01P 5/06 123/198 E |

(Continued)

FOREIGN PATENT DOCUMENTS

| | | | |
|---|---|---|---|
| CN | 1280243 | A | 1/2001 |
| CN | 1448623 | A | 10/2003 |

(Continued)

*Primary Examiner* — Gregory Huson
*Assistant Examiner* — Elizabeth M May
(74) *Attorney, Agent, or Firm* — Baker & Hostetler LLP

(57) ABSTRACT

A box-type generator driven by an engine, comprising a box-type soundproof hood assembly (3) enclosing the whole generator, a controller (2), an oil tank (19), a front and a back fans (13, 14), air ducts (11, 12), a permanent magnetic generator (4), an engine (5), a double-cavity type muffler assembly (6) and the like. With the novel designs such as forward fans air inlet (17) and controller arrangement, dual cooling air ducts and double muffler structure, and the integrated overall layout of the control system, the box-type generator ensures a generator cooling system to sequentially cool down heating components in a temperature ascending order, thus effectively reducing the system noise of a generator assembly, and facilitating the use, installation and maintenance of the generator.

6 Claims, 6 Drawing Sheets

(56) References Cited

U.S. PATENT DOCUMENTS

2002/0000342 A1* 1/2002 Yamada ..... E02F 9/0866 181/204
2002/0189556 A1* 12/2002 Morii ..... F01P 5/10 123/41.1
2004/0004356 A1 1/2004 Akimoto et al.
2006/0214425 A1 9/2006 Yamamoto et al.
2007/0108767 A1* 5/2007 Hirose ..... F02B 63/04 290/1 A
2007/0126235 A1 6/2007 Xiao
2007/0176426 A1* 8/2007 Hirose ..... B62B 5/0006 290/1 A
2007/0205350 A1* 9/2007 Shimada ..... H02K 7/1815 248/652
2008/0202447 A1* 8/2008 Kochi ..... F02B 63/04 123/2
2008/0238107 A1* 10/2008 Yamamoto ..... F02B 63/04 290/1 R
2008/0238221 A1* 10/2008 Yamamoto ..... F02B 63/04 310/51
2008/0252080 A1* 10/2008 Xiao ..... F01P 5/02 290/1 A
2009/0322097 A1* 12/2009 Hirose ..... F02B 63/04 290/1 A
2010/0187032 A1* 7/2010 Yamamura ..... B60K 11/00 180/68.2
2011/0272202 A1* 11/2011 Kawashiri ..... B62D 25/10 180/69.21
2013/0109256 A1* 5/2013 Harada ..... F02B 61/045 440/88 A
2014/0209045 A1* 7/2014 Hibi ..... F02B 77/13 123/2

FOREIGN PATENT DOCUMENTS

| | | | |
|---|---|---|---|
| CN | 1815001 | A | 8/2006 |
| CN | 1916383 | A | 2/2007 |
| CN | 2898321 | Y | 5/2007 |
| CN | 200961514 | Y | 10/2007 |
| CN | 101363362 | A | 2/2009 |
| CN | 201409047 | Y | 2/2010 |
| CN | 101702548 | A | 5/2010 |
| CN | 201466886 | U | 5/2010 |
| CN | 102383926 | A | 3/2012 |
| CN | 202325833 | U | 7/2012 |
| EP | 2075433 | A1 | 7/2009 |
| GB | 2141782 | A | 1/1985 |
| JP | 10131749 | A | 5/1998 |
| WO | WO 2011/030458 | A1 | 3/2011 |

* cited by examiner

BOX-TYPE GENERATOR DRIVEN BY ENGINE

CROSS-REFERENCE TO RELATED APPLICATIONS

This application is the National Stage of International Application No. PCT/CN2012/077889, filed Jun. 29, 2012, which claims the benefit of Chinese Application No. 201110336907.1, filed Oct. 23, 2011, the entireties of which are incorporated herein by reference for any and all purposes.

FIELD

The present application relates to a box-type generator driven by an engine, which is a generator structure with a particular layout of an air inlet, a controller, a front cooling air duct and a back cooling air duct, a front fan and a back fan, a permanent magnetic generator, an engine and a double-cavity type muffler system. With the generator structure, all generator components in a box-type soundproof hood assembly are cooled, and the noise of the generator is eliminated and prevented from leaking out. The box-type generator driven by an engine is applicable to circumstances where effects of cooling and silencing of the generator are highly required. The present application relates to generator technologies.

BACKGROUND

Conventionally, for a box-type generator in which a permanent magnetic generator is driven by an engine to generate electric power, various components such as controller, fan, permanent magnetic generator, engine, muffler, oil tank and the like are accommodated in a box-type soundproof hood with the function of sound isolation, so as to isolate the noise caused when generating the electric power, and those components are arranged as compact as possible.

Since the controller, the engine, the permanent magnetic generator and the muffler may all emit heat during operation and are covered by the soundproof hood, the temperature in the soundproof hood may be high. Hence, air should be introduced into the soundproof hood from the outside to cool the various components enclosed in the soundproof hood and to keep the components below a reliable working temperature.

For an existing box-type generator, directions of front, back, right and left of the generator are defined by observing an air outlet of the engine from the back to the front. In most of cooling structures, cooling air enters from the right and left sides of the soundproof hood. The cooling air is driven, by a single fan, to flow through a primary cooling surface of the controller, where the primary cooling surface has cooling fins. Then the cooling air is taken, by a fan, into an inner air duct for cooling the generator, and the inner air duct surrounds and cools outer surfaces of the permanent magnetic generator, the engine and the muffler. The above cooling structure is applied to a "portable generator" set forth in Chinese Patent Application No. 200610038715.1 and a "generator with engine" set forth in Chinese Patent Application No. 00120481.5. In some box-type generators, in order that the controller can prevent the noise of the generator from leaking out through an air inlet of the soundproof hood while being cooled, the controller is arranged at the air inlet at the left side of the soundproof hood and the air inlet is covered by the primary cooling surface of the controller. A dedicated cooling fan for the generator is further added to improve the effect of cooling of the generator. The above silencing and cooling structure is applied to an "engine generator" set forth in Chinese Patent Application No. 03121181.X.

SUMMARY

To overcome disadvantages of the prior art, a box-type generator is provided in the disclosure. In the box-type generator, a front air inlet is arranged on a front end surface of a box-type soundproof hood assembly, and a controller is arranged behind the front end surface. Two large surfaces and side surfaces of the controller are cooled by cooling air. The noise of the generator is prevented from leaking out via an air inlet of the soundproof hood, and the noise from an air inlet of a fan is reflected. Parts of the generator are cooled, by a front air duct and a back air duct of the generator, in an ascending order of working temperatures. Segmental cooling is performed on an engine and a muffler with highest temperatures. The volume of the muffler is increased through a segmental arrangement without increasing the volume of the generator assembly. An opening of the soundproof hood is omitted and accordingly the noise of the generator assembly is significantly reduced. It is also convenient for a producer and a user to operate, install and maintain the box-type generator.

For achieving the above objects, the box-type generator driven by the engine is arranged as follows.

A box-type generator driven by an engine is provided. The generator assembly is enclosed by a box-type soundproof hood assembly assembled by at least two pieces of soundproof hoods. A front air inlet located at a lower portion of a front end surface of the box-type soundproof hood assembly, a controller, a front fan and a front air duct, a permanent magnetic generator, the engine, a left back air inlet and a right back air inlet, a back fan and a back air duct, and a double-cavity type muffler assembly are successively arranged approximately in a line from upstream to downstream in the flow direction of cooling air. For the arrangement of the front and back air duct and the double-cavity type muffler assembly along the line, the front air duct and an upper cavity of the muffler are arranged in the upper portion of the box-type soundproof hood assembly, and the back air duct and a lower cavity of the muffler are arranged in the lower portion of the box-type soundproof hood assembly, and the upper portion and the lower portion are separated. The front air inlet is arranged at the front end surface of the box-type soundproof hood assembly, and the cooling air may be inhaled into the front air duct from the front air inlet. The controller is arranged behind the front end surface, and a big surface of the controller parallels to and covers the front air inlet. An oil tank is arranged above the controller. The cooling air in the front air duct successively cools the controller, the front fan, the permanent magnetic generator, a portion of the engine above a cylinder, an air intake tube of the double-cavity type muffler and the upper cavity of the double-cavity type muffler. At positions behind an air inlet of the front fan and near an air filter and a lower portion of the engine, the left back air inlet and the right back air inlet are respectively provided on a left soundproof hood and a right soundproof hood of the box-type soundproof hood assembly, and the air may be inhaled into the back air duct from the left back air inlet and the right back air inlet. The cooling air in the back air duct successively cools a portion of the engine below the cylinder, the back fan and the lower cavity of the double-cavity type muffler. The front fan, the back fan and the permanent magnetic generator are all driven by the engine. The cooling air flows from the front to the back both in the front air duct and in the back air duct.

The controller is arranged on a bottom soundproof hood via a damping rubber block. The oil tank is above the controller. The controller together with the oil tank is fixed to the right soundproof hood, the left soundproof hood and the bottom soundproof hood through damping rubber blocks. Gaps are formed between the left side of the controller and the inner surface of the left soundproof hood and between the right side of the controller and the inner surface of the right soundproof hood, and the cooling air may pass through the gaps. A large primary cooling surface of the controller covers the front air inlet. Since the air inlet of the fan is just behind the controller, and on the left and right sides of the soundproof hood, no other air inlets in addition to the front air inlet are further provided in front of and near the front air inlet, front cooling air can only enter through the front air inlet. First, the front cooling air flows through the primary cooling surface of the controller, where the primary cooling surface has cooling fins. The front cooling air passes through the gaps between the side surfaces of the controller and the box-type soundproof hood and between the side surfaces of the controller and the oil tank, and reaches a secondary cooling surface provided at the back surface of the controller. Then the front cooling air is inhaled from an air inlet of the front fan. Since the cooling air should surround and flow through the front surface and the back surface having large areas and side surfaces of the controller, the above structure has better cooling performance than a structure where only the primary cooling surface of the controller is cooled. The controller is a tabular cuboid, and any one of the two largest surfaces may be provided facing and covering the front air inlet. The controller is arranged between the front air inlet and the front fan. In addition, since the controller is arranged between the front air inlet and the air inlet of the fan, not only the noise of the generator leaked out via the air inlet of the fan can be reflected, but also the noise in the box-type soundproof hood assembly is prevented from leaking out via the front air inlet, and it is advantageous to reduce the noise by using diffuse reflection of sound.

The double-cavity type muffler assembly includes externally visible components such as the upper cavity and the lower cavity, the air intake tube, a connecting pipe and an air outlet of the muffler. A front air duct assembly encloses the front fan, the permanent magnetic generator, the portion of the engine above the cylinder, the air intake tube of the muffler and the upper cavity of the muffler. In the back air duct assembly, air enters from the left and right back air inlets and flows through the portion of the engine below the cylinder and through an oil pan; then the air is inhaled by the fan and supercharged. The back air duct assembly encloses and cools the lower cavity of the muffler. The front air duct assembly is connected to the portion of the engine above the cylinder by fasteners and sealing tapes, and the upper cavity and the lower cavity of the muffler are connected to the engine and the back air duct assembly by fasteners. The front air duct does not communicate with the back air duct. The front air duct and the back air duct are separated by a separator. In this way, the cooling air is supercharged by the front and back fans of the engine respectively, and successively surrounds and cools outer surfaces of the permanent magnetic generator, the engine, the air intake tube and the upper and lower cavities of the double-cavity type muffler, and the connecting pipe while flowing through the front and back air duct assemblies. The front air duct finally cools the upper cavity of the double-cavity type muffler, and the back air duct finally cools the lower cavity of the double-cavity type muffler. The front air duct and the back air duct are separated from the connecting pipe of the double-cavity type muffler. The front air duct does not communicate with the back air duct. The air outlet of the muffler is enclosed by an air outlet hood, hence, the temperatures of the bodies of the permanent magnetic generator, the engine and the double-cavity type muffler assembly and the temperature of the air discharged from the air outlet of the muffler are significantly decreased, and effects of silencing and cooling of the generator assembly are ensured. In addition, since main sonorific portions of the fans, the permanent magnetic generator, the engine, and the muffler assembly are respectively enclosed by the front and back air duct assemblies, the noise of the generator assembly may be reduced because of a soundproof function of the air ducts and the above silencing structure. To prevent the air duct assemblies from getting damaged by the high temperatures of the bodies of the front air duct assembly and the back air duct assembly due to the thermal radiation from the engine and the double-cavity type muffler assembly, heat-insulation reflective films are affixed to inner walls of some high-temperature portions of the front and back air duct assemblies. Silencing structures and sound-absorption cotton are further provided on inner and outer walls of some portions of the front and back air duct assemblies to improve the soundproof function of the front and back air duct assemblies. The front air duct assembly and the back air duct assembly are separated by a separator at the connecting pipe of the double-cavity type muffler assembly, and are not communicated with each other.

The box-type soundproof hood assembly includes the left soundproof hood, the right soundproof hood, the bottom soundproof hood, the air outlet hood, an access door and a spark plug cap. One portion of the front air inlet is manufactured on a front end surface of the left soundproof hood and another portion of the front air inlet is manufactured on a front end surface of the right soundproof hood. Alternatively, a front air inlet hood assembly may be manufactured separately and then assembled on the left soundproof hood and the right soundproof hood. Main components in the box-type soundproof hood assembly are all mounted and carried on the bottom soundproof hood directly or indirectly, and are connected by fasteners, damping rubber parts and sealing tapes. For the convenience of operators, an integrated operation panel, incorporated with all parts associated with initiation, switch, electrical output and indication, is arranged on a piece at a side portion of the box-type soundproof hood assembly. A handle and an oil filler are further provided at the upper portion of the assembled left soundproof hood and right soundproof hood. A fixing structure for mounting and fixing the oil tank is further provided on the inner surfaces of the left soundproof hood and the right soundproof hood at positions corresponding to the oil tank. Reinforcing ribs and affixed sound-absorption cotton and sealing tapes are provided on the inner surfaces of some portions of the components of the box-type soundproof hood assembly.

BRIEF DESCRIPTION OF THE DRAWINGS

Drawings used in the disclosure are as follows.

Figure 1:
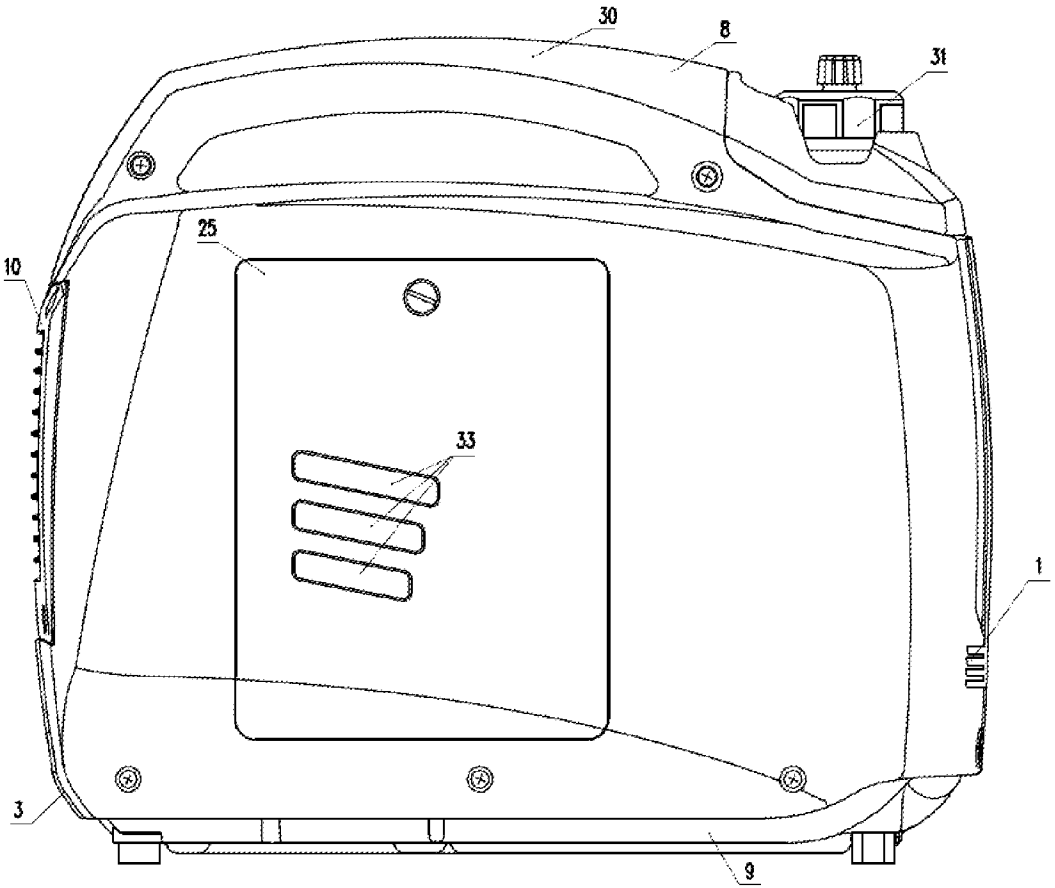
FIG. 1 is a front view of a box-type generator driven by an engine according to the disclosure.

Reference numerals in the drawings are defined as follows: 1 represents a front air inlet, 2 represents a controller, 3 represents a box-type soundproof hood assembly composed of components 7, 8, 9, 10, 25, 26 and 27, 4 represents a permanent magnetic generator (including a stator and a rotor), 5 represents the engine, 6 represents a double-cavity type muffler assembly composed of components 20, 21, 22, 23 and 24, 7 represents a left soundproof hood, 8 represents a right soundproof hood, 9 represents a bottom soundproof hood, 10 represents an air outlet hood, 11 represents a front air duct assembly, 12 represents a back air duct assembly, 13 represents a front fan, 14 represents a back fan, 15 represents a primary cooling surface, 16 represents a secondary cooling surface, 17 represents an air inlet of the front fan, 18 represents a damping rubber block, 19 represents an oil tank, 20 represents an upper cavity of the muffler, 21 represents a lower cavity of the muffler, 22 represents an air intake tube, 23 represents a connecting pipe, 24 represents an air outlet, 25 represents an access door, 26 represents a spark plug cap, 27 represents an operation panel, 28 represents a reinforcing rib, 29 represents sound-absorbing cotton, 30 represents a handle, 31 represents an oil filler, 32 represents a back air inlet of the left soundproof hood, 33 represents a back air inlet of the right soundproof hood, 34 represents an oil pump, 35 represents a heat-insulation reflective film, 36 represents a silencing structure, 37 represents a throttle cable, 38 represents an oil tube, 39 represents a master switch for oil and electricity, and 40 represents an inner generator composed of components 4, 5, 6, 11, 12, 13 and 14.

DETAILED DESCRIPTION OF EMBODIMENTS

An embodiment of the disclosure is described hereinafter in conjunction with drawings.

Figure 2:
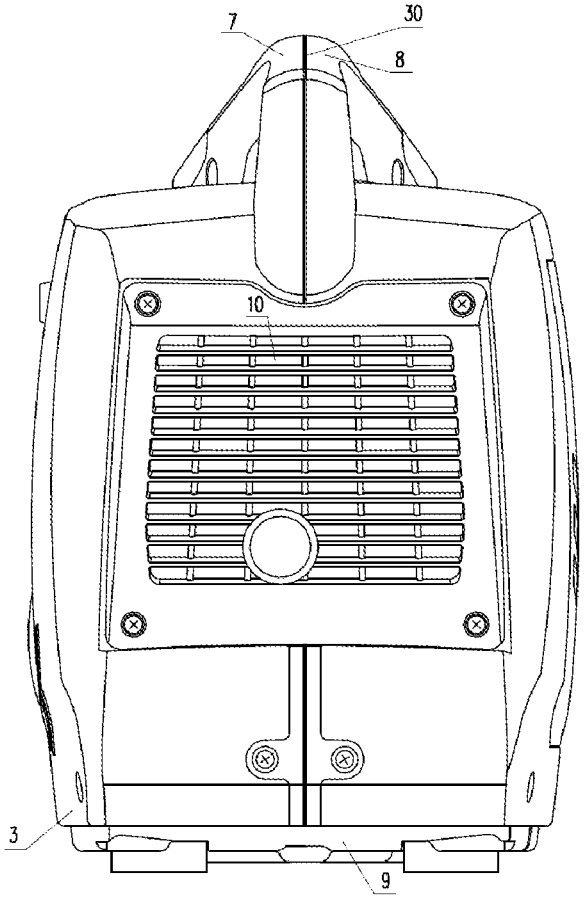
FIG. 2 is a left view of FIG. 1.
Figure 3:
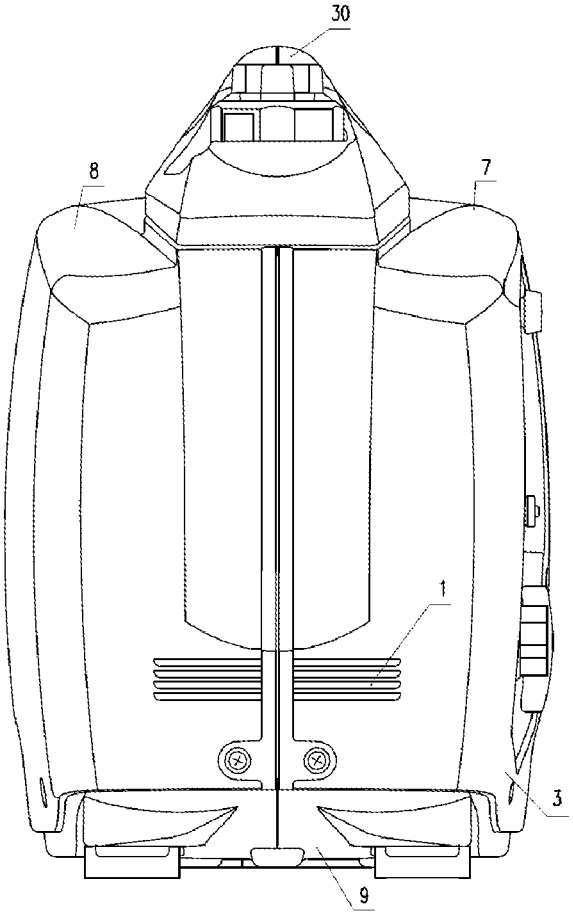
FIG. 3 is a right view of FIG. 1.
Figure 4:
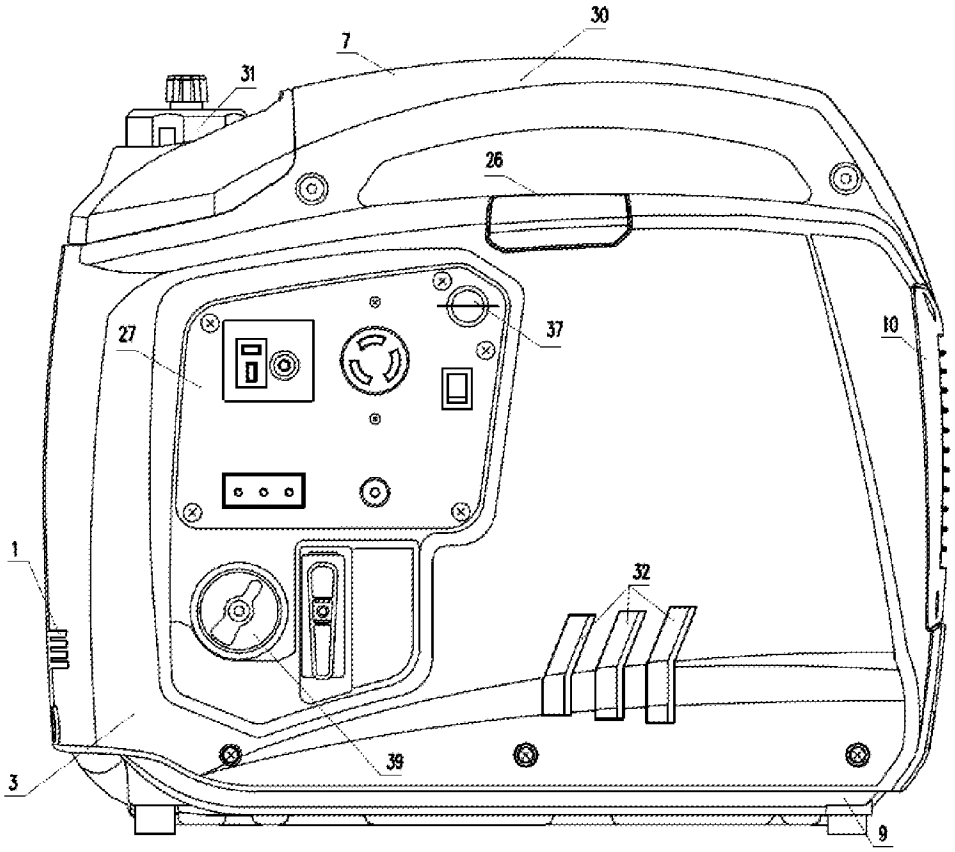
FIG. 4 is a back view of FIG. 1.
Figure 5:
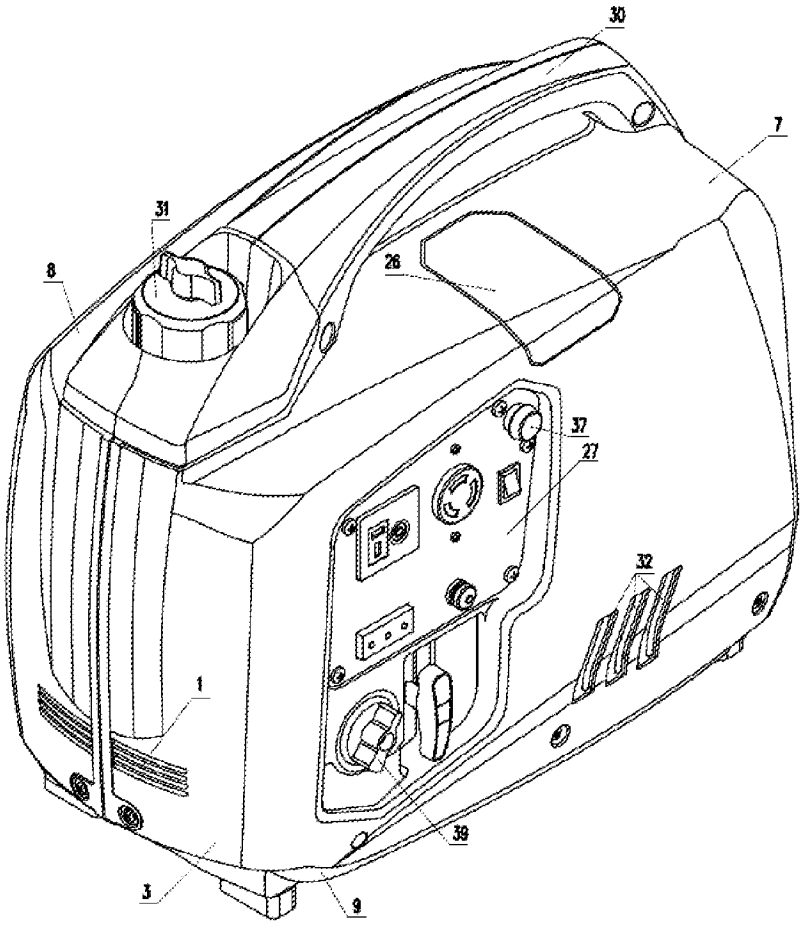
FIG. 5 is a back perspective view of FIG. 1.
Figure 6:
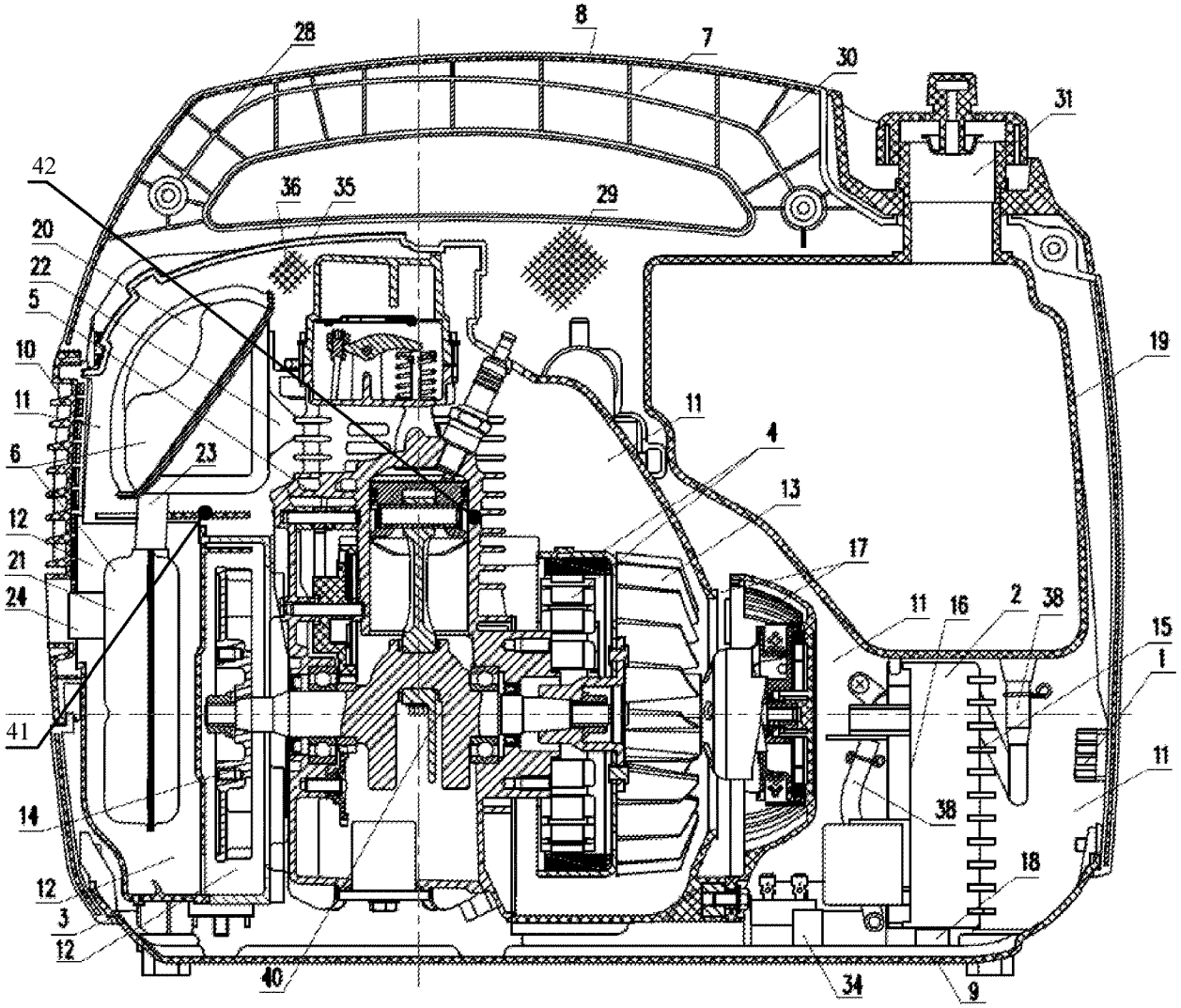
FIG. 6 is a schematic view of a longitudinal section of FIG. 1 along the center of the engine.

As shown in FIGS. 1 to 6, a box-type generator driven by an engine is provided. The generator assembly is enclosed by a box-type soundproof hood assembly 3 assembled by several pieces of soundproof hoods. The box-type generator is provided therein with main components such as a controller 2, an oil tank 19, a front fan 13, a front air duct assembly 11, a permanent magnetic generator 4, an engine 5, a back fan 14, a back air duct assembly 12, a double-cavity type muffler assembly 6, an operation panel 27, an oil pump 34 and the like.

Generator components in the box-type soundproof hood assembly 3 are arranged as shown in the drawings. A front air inlet 1, the controller 2, the front fan 13 and the front air duct assembly 11, the permanent magnetic generator 4, the engine 5, the back fan 14 and the back air duct assembly 12, the double-cavity type muffler assembly 6 and an air outlet hood 10 are successively arranged approximately in a line from the front to the back. The front air duct assembly 11, an air intake tube 22 and an upper cavity 20 of the muffler are arranged in the upper portion of the box-type soundproof hood assembly 3, and the back fan 14, the back air duct assembly 12 and a lower cavity 21 of the muffler are arranged in the lower portion of the box-type soundproof hood assembly 3. Hence, starting form the engine 5, the front and the back air duct and the enclosed components are arranged separately in the upper portion and the lower portion Flow directions of cooling air in the generator are shown by arrows in the drawings. Front cooling air enters from the front air inlet 1 located at lower portions of the front surfaces of a left soundproof hood 7 and a right soundproof hood 8, blows to a primary cooling surface 15 of the controller 2, and surrounds side surfaces and a secondary cooling surface 16 of the controller 2. The front cooling air is inhaled, by the front fan 13, into the front air duct assembly 11 from an air inlet 17 of the front fan, and successively surrounds and cools the permanent magnetic generator 4, the portion of the engine 5 above a cylinder, the air intake tube 22 and outer surfaces of the upper cavity 20 of the muffler. Then the front cooling air is discharged from the upper half portion of the air outlet hood 10. Back cooling air enters from a back air inlet 32 of the left soundproof hood 7 and a back air inlet 33 of the right soundproof hood 8, firstly cools the portion of the engine below the cylinder, then is inhaled in the back air duct assembly 12 by the back fan 14 and is supercharged, surrounds and cools the outer surface of the lower cavity 21 of the double-cavity type muffler, and subsequently is discharged from the lower half portion of the air outlet hood 10. The front air duct assembly 11 and the back air duct assembly 12 are separated by a separator 41 provided at a connecting pipe 23 of the double-cavity type muffler assembly 6, accordingly, the front air duct assembly 11 and the back air duct assembly 12 do not communicate with each other. The cooling air flows from the front to the back both in the front air duct and in the back air duct.

The controller 2 is arranged on a bottom soundproof hood 9 via a damping rubber block 18. The oil tank 19 is above the controller 2. Gaps are formed between the left side of the controller 2 and the inner surface of the left soundproof hood 7, and between the right side of the controller 2 and the inner surface of the right soundproof hood 8, to allow the cooling air to pass though. The primary cooling surface 15 of the controller covers the front air inlet 1. The air inlet 17 of the front fan is behind the secondary cooling surface 16 of the controller 2, and the back air inlet 32 of the left soundproof hood and the back air inlet 33 of the right soundproof hood are behind the air inlet 17 of the front fan, the front cooling air may only enter through the front air inlet 1. First the front cooling air flows through the primary cooling surface 15 of the controller 2, where the primary cooling surface 15 has cooling fins. The front cooling air further flows through the gap between the left side of the controller and the inner surface of the left soundproof hood 7 and the gap between the right side of the controller and the inner surface of the right soundproof hood 8, and reaches the secondary cooling surface 16 of the controller. Then the front cooling air is inhaled, by the front fan 13, into the front air duct assembly 11 from the air inlet 17 of the front fan. Since the cooling air should surround and flow through the primary cooling surface 15, the secondary cooling surface 16 and the side surfaces of the controller 2, the above structure has better cooling performance than a structure in which only the primary cooling surface of the controller is cooled. At the same time, since the controller 2 is arranged between the front air inlet 1 and the air inlet 17 of the front fan, not only the noise of the generator leaked out of the air inlet 17 of the front fan is reflected, but also the noise inside the box-type soundproof hood assembly 3 is prevented from leaking out via the front air inlet 1, and it is advantageous to reduce the noise by using diffuse reflection of sound.

The double-cavity type muffler assembly 6 includes externally visible components such us the upper cavity 20 of the muffler, the lower cavity 21 of the muffler, the air intake tube 22, the connecting pipe 23, and an air outlet 24. The front air duct assembly 11 encloses the front fan 13, the permanent magnetic generator 4, the portion of the engine 5 above the cylinder, the air intake tube 22 of the muffler and the upper cavity 20 of the muffler. In the back air duct assembly, air enters the back air duct assembly 12 from the back air inlet 32 of the left soundproof hood and the back air inlet 33 of the right soundproof hood, and flows through the portion of the engine 5 below the cylinder and through an oil pan. Then the air is inhaled by the back fan 14 and supercharged. Then the air encloses and cools the outer surface of the lower cavity 21 of the muffler. The front air duct assembly 11 is connected to the portion of the engine 5 above the cylinder by fasteners and sealing tapes, and the upper cavity and lower cavity of the double-cavity type muffler assembly 6 are connected to the engine 5 and the back air duct assembly 12 by fasteners. The air outlet 24 of the muffler is enclosed by the air outlet hood 10. In this way, the cooling air supercharged by the front fan 13 and the back fan 14 of the engine 5 surrounds and cools the outer surfaces of the permanent magnetic generator 4, the engine 5 and the double-cavity type muffler assembly 6 while flowing through the front air duct assembly 11 and the back air duct assembly 12. Accordingly, the temperatures of the bodies of the permanent magnetic generator 4, the engine 5 and the double-cavity type muffler assembly 6 and the temperature of the air discharged from the air outlet 24 of the muffler are significantly decreased, and it is advantageous to improve the effects of silencing and cooling of the generator assembly. In addition, since the components are cooled, by the cooling air in the front and back air ducts, in an ascending order of temperatures and the cooling air is not split, the total working efficiency of the fans is improved and thermal radiation from high-temperature components of the generator to low-temperature components of the generator is reduced. Furthermore, since main portions of the front fan 13, the permanent magnetic generator 4, the engine 5, the back fan 14 and the double-cavity type muffler assembly 6 are respectively enclosed by the front air duct assembly 11 and the back air duct assembly 12, the noise of the generator assembly may be reduced with a soundproof function of the air ducts and the above silencing structure. To prevent the air duct assemblies from getting damaged by the high temperatures of the bodies of the front air duct assembly 11 and the back air duct assembly 12 due to the thermal radiation from the engine 5 and the double-cavity type muffler assembly 6, heat-insulation reflective films 35 are affixed to inner walls of some high-temperature portions of the front air duct assembly 11 and the back air duct assembly 12. Silencing structures 36 and sound-absorption cotton 29 are further provided on inner and outer walls of some portions of the front air duct assembly 11 and the back air duct assembly 12 to improve the soundproof function of the front air duct assembly 11 and the back air duct assembly 12.

The box-type soundproof hood assembly 3 includes the left soundproof hood 7, the right soundproof hood 8, the bottom soundproof hood 9, the air outlet hood 10, an access door 25, a spark plug cap 26, and an operation panel 27. One portion of the front air inlet 1 is manufactured on the front end surface of the left soundproof hood 7, and another portion of the front air inlet 1 is manufactured on the front end surface of the right soundproof hood 8. With a sealing connecting structure and fasteners, the above components are assembled to from the box-type soundproof hood assembly 3. The bottom soundproof hood 9 is a main carrier. The controller 2, an inner generator 40 and an oil pump 34 are mounted on the bottom soundproof hood 9 by dampers or fasteners. The left soundproof hood 7 and the right soundproof hood 8, carrying the oil tank 19, the integrated operation panel 27, the air outlet hood 10, the access door 25, the spark plug cap 26 and the like, are also mounted on the bottom soundproof hood 9. With the above structure, it is very convenient to assemble and maintain the components. General maintenance works such as maintenance of an air filter, oil change for the engine 5, adjustment of a carburetor, etc., may be performed simply after opening the access door 25, examination and replacement of a spark plug may be performed after loosening the spark plug cap 26, and various assemblies, wires, oil tubes, cables and the like in the generator may be accessible conveniently after loosening the fasteners on the left soundproof hood 7 and the right soundproof hood 8. Since fewer components are associated with each other, the requirements on skills and special equipment are low during assembly, and the trouble, existing on many box-type generators, that many components are separated from each other and hard to be assembled once the soundproof assembly is detached, may not be introduced. A handle 30 and an oil filler 31 are provided at the upper portion of the assembled left soundproof hood 7 and right soundproof hood 8 to facilitate the usage and to improve the effect of silencing. A fixing structure for the oil tank 19 is provided on the inner surfaces of the left soundproof hood 7 and the right soundproof hood 8 at positions corresponding to the oil tank. The oil filler 31 is provided at the upper portion of the oil tank 19. Reinforcing ribs 28 and affixed sound-absorption cotton 29 are provided on some portions of the inner surfaces of the left soundproof hood 7 and the right soundproof hood 8, the bottom soundproof hood 9, the air outlet hood 10, the access door 25 and the spark plug cap 26 to improve the strength and the effect of silencing.

For the convenience of user operation, the integrated operation panel 27, incorporated with all parts associated with initiation, switch, electrical output and indication, is arranged on the left soundproof hood 7 of the box-type soundproof hood assembly 3, to avoid the problem in connection with the conventional box-type generator that a user has to follow procedures one-by-one to perform operations on several surfaces of the generator to initiate or to stop the generator, while some operations or details may be forgotten. Furthermore, with the operation panel 27, a smaller circumferential space is required during the usage of the generator, and it is also advantageous to connect wires of the controller 2, the throttle cable 37 and the oil tube 38 to the operation panel 27. In addition, according to the disclosure, since a bottom plate of the operation panel 27 is integrated with the left soundproof hood 7, the strength of the left soundproof hood 7 is increased, and a panel opening and a conventional bottom hood of the operation panel are omitted. With this design, structures of respective components of the box-type soundproof hood assembly 3 are significantly simplified, the opening on the panel is omitted and accordingly the noise is prevented from being leaked out of the opening, and it is advantageous to perform novel and attractive appearance design. Since a master switch for oil and a master switch for electricity are integrated into a master switch 39 for oil and electricity and the master switch 39 for oil and electricity is arranged below the bottom of the oil tank 19, it is ensured that the master switch for oil and the master switch for electricity may be simultaneously turned on or turned off when the master switch 39 for oil and electricity is turned on or turned off. Accordingly, the operation is simplified, and the risk that one of the switch for oil and the switch for electricity is forgotten to be turned off while the other is turned off is eliminated. It is ensured that oil can arrive to an oil inlet of the oil pump 34 by gravity after the master switch 39 for oil and electricity is turned on, and the oil pump 34 is arranged below and near the carburetor 36; hence, the number of times of manual pulling for initiating the oil pump 34 for the first time to pump oil is significantly decreased. With these humanized designs, it is very advantageous for the easy usage by ordinary users, requirements for user skills and sites are lowered, and it is also advantageous to reduce the noise of the generator assembly.

What is claimed is:

1. A box-type generator driven by an engine, wherein a generator assembly is enclosed by a box-type soundproof hood assembly assembled by at least two pieces of soundproof hoods;

wherein a front air inlet located at a lower portion of a front end surface of the box-type soundproof hood assembly, a controller, a front fan and a front air duct, a permanent magnetic generator, the engine, a left back air inlet and a right back air inlet, a back fan and a back air duct, and a double-cavity type muffler assembly are successively arranged approximately in a line from upstream to downstream in a flow direction of cooling air, wherein the double-cavity type muffler assembly comprises an upper cavity and a lower cavity, an air intake tube, a connecting pipe and an air outlet, and in an arrangement of the front and back air duct and the double-cavity type muffler assembly along the line, the front air duct and the upper cavity of the muffler are arranged in an upper portion of the box-type soundproof hood assembly, while the back air duct and the lower cavity of the muffler are arranged in a lower portion of the box-type soundproof hood assembly, and the upper portion and the lower portion of the box-type soundproof hood assembly are separated from each other;

wherein the front air inlet is arranged at the front end surface of the box-type soundproof hood assembly, and cooling air is inhaled into the front air duct from the front air inlet;

wherein the controller is arranged behind the front end surface, parallels to a large surface and covers the front air inlet, and an oil tank is arranged above the controller;

wherein the cooling air in the front air duct successively cools the controller, the front fan, the permanent magnetic generator, a portion of the engine above a cylinder, the air intake tube of the double-cavity type muffler and the upper cavity of the double-cavity type muffler;

wherein the left back air inlet and the right back air inlet are respectively provided on a left soundproof hood and a right soundproof hood of the box-type soundproof hood assembly at positions behind an air inlet of the front fan and near an air filter and a lower portion of the engine, and air is inhaled into the back air duct from the left back air inlet and the right back air inlet;

wherein the cooling air in the back air duct successively cools another portion of the engine below the cylinder, the back fan and the lower cavity of the double-cavity type muffler; and wherein the front fan, the back fan and the permanent magnetic generator are all driven by the engine, and the cooling air flows from front to back both in the front air duct and in the back air duct;

wherein the connecting pipe is used to connect the upper cavity and the lower cavity of the double-cavity type muffler assembly; and wherein the front air duct and the back air duct are separated at a position of the connecting pipe of the double-cavity type muffler, and the front air duct does not communicate with the back air duct.

2. The box-type generator driven by the engine according to claim 1, wherein the controller is a tabular cuboid, two large surfaces of the controller are selectively arranged facing and covering the front air inlet, and the controller is arranged between the front air inlet and the front fan.

3. The box-type generator driven by the engine according to claim 1, wherein the box-type soundproof hood assembly comprises the left soundproof hood, the right soundproof hood, a bottom soundproof hood, an air outlet hood, an access door and a spark plug cap;

wherein one portion of the front air inlet is manufactured on a front end surface of the left soundproof hood and another portion of the front air inlet is manufactured on a front end surface of the right soundproof hood, or a front air inlet hood is manufactured separately to be assembled on the left soundproof hood and the right soundproof hood; and wherein main components in the box-type soundproof hood assembly are all mounted and carried on the bottom soundproof hood directly or indirectly.

4. The box-type generator driven by the engine according to claim 3, wherein an integrated operation panel is arranged on a piece at a side portion of the box-type soundproof hood assembly.

5. The box-type generator driven by the engine according to claim 3, wherein the front air duct is not communicated with the back air duct, and the front air duct and the back air duct are separated by a separator.

6. The box-type generator driven by the engine according to claim 5, wherein the upper cavity of the double-cavity type muffler is the last to be cooled by the front air duct, and the lower cavity of the double-cavity type muffler is the last to be cooled by the back air duct; and wherein the air outlet of the muffler is enclosed by the air outlet hood.

* * * * *